United States Patent [19]

Knox et al.

[11] 4,047,688

[45] Sept. 13, 1977

[54] PAGE KEEPER

[76] Inventors: Betty C. Knox, 4915 E. Mtn. View Drive, San Diego, Calif. 92116; Sally W. Schneider, 10047 Diversion Drive, Spring Valley, Calif. 92077

[21] Appl. No.: 648,126

[22] Filed: Jan. 12, 1976

[51] Int. Cl.[2] ..... A47B 97/04

[52] U.S. Cl. ..... 248/451; 248/500

[58] Field of Search ..... 211/51, 443; 248/451, 248/452, 453, 500, 504

[56] References Cited

U.S. PATENT DOCUMENTS

| | | | |
|---|---|---|---|
| 452,683 | 5/1891 | Walker | 248/451 |
| 774,814 | 11/1904 | Adams | 248/451 |
| 1,553,368 | 9/1925 | Cookenboo | 211/51 X |
| 2,084,409 | 6/1937 | Peterson | 248/504 |
| 3,544,056 | 12/1970 | Berquist | 248/443 |
| 3,635,478 | 1/1972 | Hatley | 211/51 X |

*Primary Examiner*—William H. Schultz
*Attorney, Agent, or Firm*—William F. Frank

[57] ABSTRACT

A page keeper having a spring clip such as a clothespin and being removably coupled to a music rack thereby with a spring wire fixedly attached to the spring clip and extending therefrom with at least one spring coil at a first corner bend and with a second corner bend disposed over a page on a music rack or other reading aid and terminating in a smooth surfaced ball for reducing slidable friction to any page it is resting upon and keeping in an open position.

2 Claims, 2 Drawing Figures

PAGE KEEPER

PRIOR ART

The following U.S. Pat. Nos. were discovered in a preliminary search: W. F. Shaw 458,074, F. L. Lyman 860,397, G. S. Richmond 359,180, T. W. Hogsett 1,559,431.

BRIEF DESCRIPTION OF THE INVENTION

The present invention relates to a page keeper and more particularly to a page keeper which can be removably coupled to a reading aid such as a music rack on a piano or an organ.

According to the invention, a page keeper is provided in which a spring wire is fixedly attached to and extending from a spring clip, such as a plastic clothespin. The spring clip is dimensioned for a removable attachment to a reading aid, such as a music rack, and is coated with a non-abrasive material such as Teflon on its gripping jaws to prevent marring of the reading aid. The spring wire extends from the spring clip making a right angle curve from one edge of the music rack over toward the area where an open page would lie. Another right angle curve directs the spring wire toward and into the music rack in the area where a page of sheet music or music book would normally rest. The spring wire terminates in a smooth rounded surface, such as a sphere or ball; for example, a bead. If necessary, one or more spring coils can be formed at the first right angle curve in proximity to the spring clip for added spring tension.

An object of the present invention is the provision of an improved page keeper.

Another object of the invention is the provision of a page keeper which can be removably attached to a reading aid.

A further object of the invention is the provision of a removable page keeper which will not mar a finish of a reading aid.

Yet another object of the invention is the provision of a page keeper which will not injure the page that it is keeping.

A still further object of the invention is the provision of a page keeper which is inexpensive to manufacture and extremely convenient in use.

Other objects and many of the attendant advantages of the present invention will be readily appreciated as the same becomes better understood by reference to the following detailed description when considered in connection with the accompanying drawings in which like reference numerals designate like parts throughout the Figures thereof and wherein:

FIG. 1 is a perspective view of the preferred embodiment of the present invention in situ; and FIG. 2 is a top view of the embodiment of FIG. 1.

DETAILED DESCRIPTION OF THE DRAWING

Figure 1:
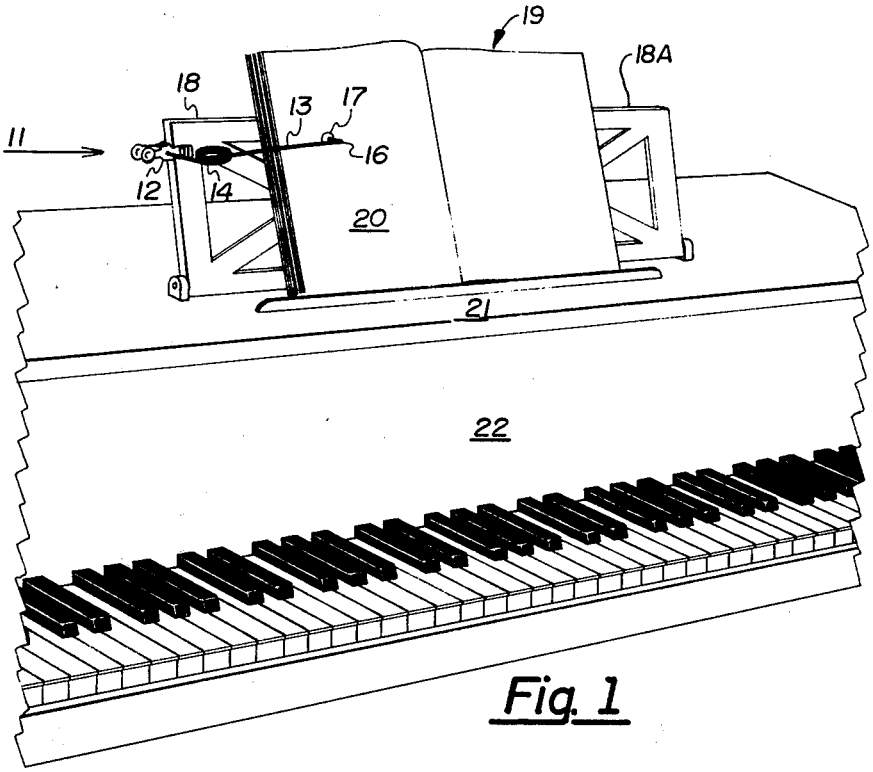

Referring to FIG. 1, the page keeper of the present invention is shown generally at 11 having a spring-loaded clip 12 with spring wire 13 fixedly attached to and extending therefrom. Spring wire 13 has a coil spring section 14 at a first curve coming out of spring-loaded clip 12 and a second curve 16 terminating in a ball or sphere 17. Spring clip 13 is removably attached to music rack 18 and ball 17 is in frictional engagement with page 20 of a book 19 shown in phantom and carried by music rack 18. Music rack 18 is carried by the top portion 21 of piano or organ shown generally at 22.

Figure 2:
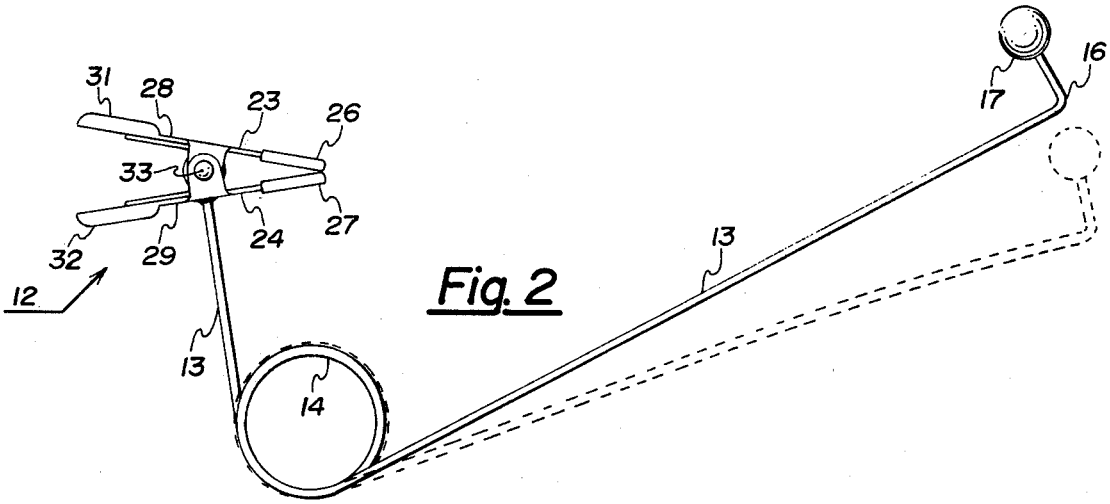

Referring to FIG. 2, spring clip 12 has a pair of jaws 23 and 24 which are Teflon-coated at their tips 26 and 27, respectively. Handle portions 28 and 29 are also coated at 31 and 32, respectively. Jaw portions 23 and 24 are rotatably coupled at 33 with spring wire 13 fixedly attached in the same area. Spring wire 13 has a pair of spring coils 14 and extends to a ball or sphere 17 after a right angle curve 16.

Referring back to FIGS. 1 and 2, it can be seen that spring clip 13 with Teflon-coated ends 26 and 27 of jaw portions 23 and 24, respectively, is removably clipped to a music rack 18. Spring wire 13 extending from spring clip 11 terminates at ball or sphere 17 in frictional engagement with a page 20 of book 19. In operation, as the page opposite 20 has been played, the next page can be conveniently turned and slipped under ball or sphere 17 and is conveniently kept in place thereby. The entire assembly can be rotated 180° and placed on the opposite edge 18A of music rack 18 when the majority of the pages of the book 19 are to the right.

It should be understood, of course, that the foregoing disclosure relates to only a preferred embodiment of the invention, and that it is intended to cover all changes and modifications of the example of the invention herein chosen, for the purposes of the discloure, which do not constitute departures from the spirit and scope of the invention.

The invention claimed is:

1. A device for restraining pages of bound material placed on a reading aid comprising, a spring clip for attachment to said reading aid, a spring wire fixedly attached to said clip and having a first portion extending outwardly at a right angle therefrom to at least one coil of said wire for biasing said wire toward said reading aid, a second portion extending from said at least one coil so as to project over a part of said reading aid to a substantially right-angled curve and a third portion extending laterally from said terminus of said second portion toward said reading aid, said third portion terminating in a sphere, said clip comprising a pair of jaws which are pivotally coupled together, said first portion of said wire being attached to one of said jaws in the area of said coupling, the interior surfaces of said jaws having non-abrasive coatings.

2. The device according to claim 1, wherein each of said jaws has a handle portion, each handle portion having a non-abrasive coating on the exterior surface thereof.

* * * * *